US007872424B2

(12) United States Patent
Sun et al.

(10) Patent No.: US 7,872,424 B2
(45) Date of Patent: Jan. 18, 2011

(54) LIGHTING APPARATUS WITH CURRENT FEEDBACK

(75) Inventors: Chia-Hung Sun, Hsinchu (TW); Tsung-Shiun Lee, Hsinchu (TW); Hsing-Ju Chen, Hsinchu (TW); Cheng-Neng Liao, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 820 days.

(21) Appl. No.: 11/767,530

(22) Filed: Jun. 25, 2007

(65) Prior Publication Data

US 2008/0203944 A1 Aug. 28, 2008

(30) Foreign Application Priority Data

Feb. 26, 2007 (TW) ..... 96106383 A

(51) Int. Cl.
*H05B 37/00* (2006.01)

(52) U.S. Cl. ..... 315/219; 315/276; 315/307

(58) Field of Classification Search ..... 315/294, 315/307, 308, 219, 224, 276, 278, 277, 279
See application file for complete search history.

(56) References Cited

U.S. PATENT DOCUMENTS

| | | | |
|---|---|---|---|
| 6,310,444 | B1 | 10/2001 | Chang |
| 6,534,934 | B1 | 3/2003 | Lin et al. |
| 6,717,372 | B2 | 4/2004 | Lin et al. |
| 2005/0007029 | A1 | 1/2005 | Fushimi |

FOREIGN PATENT DOCUMENTS

| | | |
|---|---|---|
| TW | M278026 | 10/2005 |

OTHER PUBLICATIONS

"Office Action of Taiwan Counterpart Application", issued on Jul. 13, 2010, p. 1-p. 5, in which the listed reference was cited.

*Primary Examiner*—David Hung Vu
(74) *Attorney, Agent, or Firm*—Jianq Chyun IP Office

(57) ABSTRACT

A lighting apparatus comprises a plurality of light sources, a power conversion circuit, a plurality of load-driving coils and a feedback generation coil. The power conversion circuit generates a driving signal for the load-driving coils to generate substantially identical driving currents for driving every light source. Furthermore, the feedback generation coil generates a feedback signal based on the inductions of the currents flowing though the plurality of load driving coils.

31 Claims, 4 Drawing Sheets

LIGHTING APPARATUS WITH CURRENT FEEDBACK

CROSS-REFERENCE TO RELATED APPLICATION

This application claims the priority benefit of Taiwan application serial no. 96106383, filed Feb. 26, 2007. All disclosure of the Taiwan application is incorporated herein by reference.

BACKGROUND OF THE INVENTION

1. Field of the Invention

The present invention generally relates to a current feedback, and more particularly, to a lighting apparatus with feedback function.

2. Description of Related Art

In the present 3C (computer, communication and consumer electronics) age, the current market is full of diverse and attractive information equipments and various digital means, such as mobile phone, digital camera, digital camcorder, notebook PC and desktop computer, all of which are being developed at a startling pace targeting at providing more convenience, multi functions and pretty looking design.

Most of the information equipments today use a flat panel display as the interface thereof. By means of the display function of a flat panel display, the product can be more conveniently operated. Among the flat panel displays, a liquid crystal display (LCD), due to its advantageous features such as high display quality, small space utilization, low power consumption and no radiation, has gradually replaced the cathode ray tube (CRT) display and became the mainstream display market.

An LCD panel itself has no luminant function, and thus a backlight module is needed to be disposed beneath the PCL panel. The backlight module serves as a high quality and stable light source for LCD display. The LCD display quality largely depends on the design of the backlight module. In particular, the LCD display quality gives an overwhelming effect on brightness and the brightness uniformity of the cathode fluorescence lamp (CFL) inside a backlight module.

U.S. Pat. No. 6,534,934 B1 discloses a multi-lamp driving system, wherein a current-balancing controller composed of passive components is employed to balance and equalize currents of lamps. The proposed current-balancing controller may generate a characteristic error of the multi passive components and cause a mismatch problem. Since the feedback signal is directly provided from the low-side of a single lamp, thus, the feedback scheme is unable to suit multi sets of lamps, which results in a current deviation between the lamp where a feedback signal is taken from and other sets of lamps and, an unequal current allocation to the lamps and insufficient brightness uniformity of the backlight source. In addition, the architecture of the multi-lamp driving system employing the current-balancing controller in feedback mode would largely increase the design cost of a converter and occupy more space on a printed circuit board (PCB).

U.S. Pat. No. 6,717,372 B2 provides another multi-lamp driving system, wherein a current-balancing controller composed of magnetic core components is employed. Similar to the above-mentioned multi-lamp driving system proposed by U.S. Pat. No. 6,534,934 B1, the multi-lamp driving system is unable to feedback lamp currents and encounters the same above-mentioned problems.

SUMMARY OF THE INVENTION

Accordingly, the present invention is directed to a balancing transformer capable of generating a feedback current.

The present invention is also directed to a backlight device with a lower hardware cost and feedback control function.

The present invention is also directed to a light source driving circuit capable of driving a plurality of light sources in a synchronized manner.

As embodied and broadly described herein, the present invention provides a light source driving circuit suitable for driving a plurality of light sources in a synchronized manner. The light source driving circuit provided by the present invention includes a power conversion circuit, a plurality of load-driving coils and a feedback generation coil, wherein the power conversion circuit transmits a driving signal to the plurality of load-driving coils, and the load-driving coils respectively drive a corresponding light source according to the driving signal. The feedback generation coil is employed for generating a feedback signal to the power conversion circuit based on the inductions of the electric and magnetic flux generated by the currents flowing though the plurality of load-driving coils. In addition, the plurality of load-driving coils shares a common core.

According to an embodiment of the present invention, the number of turns of the above-mentioned plurality of load-driving coils is the same.

According to an embodiment of the present invention, the above-mentioned feedback generation coil and the plurality of load-driving coils have a common core structure.

According to an embodiment of the present invention, the number of the above-mentioned plurality of load-driving coils is an even number.

According to an embodiment of the present invention, the above-mentioned plurality of load-driving coils and feedback generation coil has a same number of turns.

According to an embodiment of the present invention, the above-mentioned plurality of load-driving coils has different number of turns compared to that of the feedback generation coil.

According to an embodiment of the present invention, the above-mentioned power conversion circuit includes a power circuit and a transformer. The power circuit is suitable for electrically connecting to a power supply, while the transformer has a primary side and a secondary side, wherein the primary side is coupled to the power circuit and the secondary side outputs a driving signal.

The present invention provides a lighting apparatus, which includes a plurality of first light sources, a first power conversion circuit, a plurality of first load-driving coils and a first feedback generation coil, wherein the first power conversion circuit is employed for generating a first driving signal to drive the plurality of first light sources. The plurality of first load-driving coils has a common core structure, the first terminal of each first load-driving coil receives a first driving signal, the second terminals thereof are respectively coupled to a corresponding one of the plurality of first light sources, and the first feedback generation coil generates a feedback signal to the power conversion circuit based on the inductions of the electric and magnetic flux generated by the currents flowing though the plurality of first load-driving coils.

According to an embodiment of the present invention, the above-mentioned first feedback generation coil and the plurality of first load-driving coils have a common core structure.

According to an embodiment of the present invention, the number of turns of the above-mentioned plurality of load-driving coils is different from each other.

According to an embodiment of the present invention, the number of the above-mentioned plurality of load-driving coils is an even number.

According to an embodiment of the present invention, the number of turns of the above-mentioned plurality of load-driving coils is different from that of the feedback generation coil.

According to an embodiment of the present invention, the above-mentioned power conversion circuit includes a power circuit and a transformer. The power circuit is suitable for electrically connecting to a power supply, while the transformer has a primary side and a secondary side, wherein the primary side is coupled to the power circuit and the secondary side outputs a driving signal.

According to an embodiment of the present invention, the above-mentioned lighting apparatus further includes a feedback circuit and a control unit, wherein the feedback circuit receives a feedback signal and the control unit is employed for controlling the first power conversion circuit and adjusting a first driving signal.

According to an embodiment of the present invention, the above-mentioned lighting apparatus further includes a second power conversion circuit suitable for electrically connecting to a power supply and generating a second driving signal.

According to an embodiment of the present invention, the above-mentioned lighting apparatus further includes a plurality of second light sources, a plurality of second load-driving coils and a second feedback generation coil, wherein the plurality of second load-driving coils has a common core structure, the first terminal of each second load-driving coil receives a second driving signal, the second terminals thereof are respectively coupled to a corresponding one of the plurality of second light sources, and the second terminal of the first feedback generation coil and the second terminal of the second feedback generation coil are coupled to each other to transmit the driving signal to the feedback circuit.

According to an embodiment of the present invention, the number of the above-mentioned second load-driving coils is an even number.

According to an embodiment of the present invention, the above-mentioned lighting apparatus further includes a plurality of third load-driving coils and a third feedback generation coil, wherein the plurality of third load-driving coils has a common core structure, the first terminal of each third load-driving coil receives a second driving signal, the second terminals thereof are respectively coupled to a corresponding one of the plurality of first light sources, and the plurality of third load-driving coils and the plurality of first load-driving coils are respectively disposed at both ends of the plurality of light sources. The third feedback generation coil and the plurality of third load-driving coils have a common core structure, wherein the first terminal of the third feedback generation coil is coupled to the second terminal of the first feedback generation coil, the second terminal of the third feedback generation coil and the first terminal of the first feedback generation coil are together coupled to the feedback circuit for transmitting the feedback signal thereto.

According to an embodiment of the present invention, the number of the above-mentioned third load-driving coils is an even number.

According to an embodiment of the present invention, the signals of the above-mentioned plurality of third load-driving coils to be transmitted to the first light source and the signals of the above-mentioned plurality of first load-driving coils to be transmitted to the first light source are inverted to each other.

The present invention further provides a balancing transformer for adjusting the load current of a driving circuit. The balancing transformer of the present invention includes a first coil, a second coil and a third coil, wherein the first terminal of the first coil receives a driving signal and the second thereof is coupled to a first load, the first terminal of the second coil receives the driving signal and the second terminal thereof is coupled to a second load, and the third coil is employed for generating a feedback signal to the driving circuit based on the inductions of the currents flowing though the first coil and the second coil.

According to an embodiment of the present invention, the above-mentioned first coil, the second coil and the third coil have a common core structure.

According to an embodiment of the present invention, the number of turns of the above-mentioned first coil and second coil are the same.

According to an embodiment of the present invention, the number of turns of the above-mentioned first coil, second coil and third coil are the same.

According to an embodiment of the present invention, the number of turns of the above-mentioned first coil, second coil and third coil is different from each other.

The balancing transformer of the present invention has a feedback function and a common core structure which enables the electric and magnetic fluxes on magnetic circuits with a common core induce by each other and the plurality of loads surrounds a magnetic linkage coupling so as to equalize the load currents of all the load coils. In addition, the balancing transformer includes a feedback generation coil for outputting a feedback current by means of the electric and magnetic flux to induce the energies of other coils. Moreover, a control unit is used to adjust the feedback current to an ideal value to make the light source luminance reach the preferred ideal setting value.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
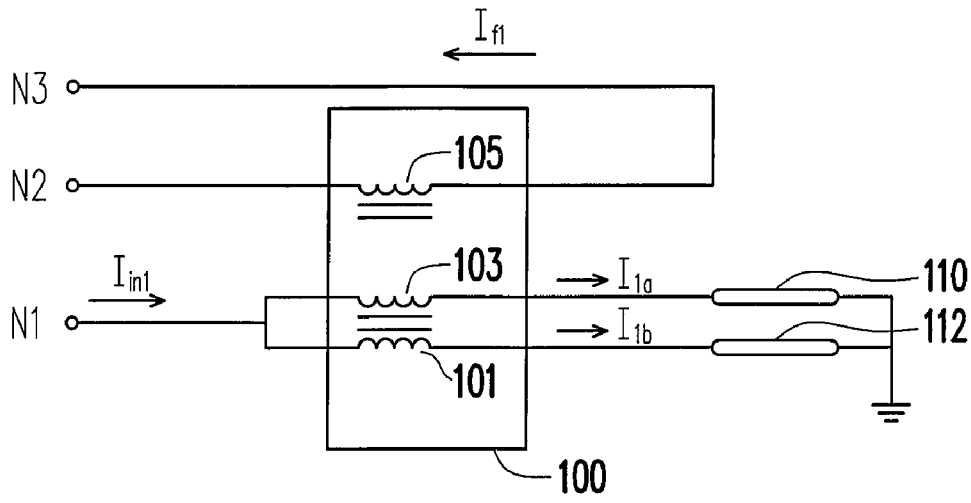
FIG. 1 is a diagram of a driving circuit with feedback control according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a diagram of a driving circuit with feedback control according to an embodiment of the present invention. Referring to FIG. 1, a driving circuit provided by the embodiment includes a balancing transformer 100. The balancing transformer 100 may synchronously drive a plurality of loads, for example, loads 110 and 112 according to a driving signal $I_{in1}$. In the present embodiment, the driving signal $I_{in1}$ is, for example, a current, which can be generated by a power conversion circuit (for example, 314 in FIG. 3).

The balancing transformer 100 includes coils 101, 103 and 105. More particularly, the three coils have a common core structure for generating load currents $I_{1a}$ and $I_{1b}$ to drive the loads 110 and 112. A terminal of each of the coils 101 and 103 is coupled to a common node $N_1$, while other terminals thereof are respectively coupled to the coil 110 and the coil 112. It should be noted that the present embodiment does not limit the number of turns of the coils 101, 103 and 105, wherein the turn numbers of the coils 101 and 103 can be the same or different from each other. Furthermore, the turn numbers of the coils 101, 103 and 105 can be the same or different from each other as well. In the present embodiment, the turn numbers of the coils 101 and 103 are the same. The loads 110 and 112 can be a cathode fluorescence lamp (CFL). Both terminals of the coil 105 are respectively coupled to nodes $N_1$ and $N_2$ for generating a feedback signal to the driving circuit based on the inductions of the electric and magnetic flux generated by the currents flowing though the coil 101 and the coil 103.

For driving the loads 110 and 112, a driving signal $I_{in1}$ is input to the node $N_1$, so that the driving signal $I_{in1}$ flows into the coils 101 and 103 via the node $N_1$. Since the magnetic inductions and the turn numbers of the coils 101 and 103 are the same, and a magnetic linkage coupling is presented between the coil 101 and the coil 103, the load currents $I_{1a}$ and $I_{1b}$ of the coils 110 and 112 are the same, i.e., $I_{1a}$-$I_{1b}$ which indicates a balanced state. At the time, an electric and magnetic flux flows along a magnetic circuit in the magnetic core of the transformer 100, which would generate an inductive electromotive force (EMF) within the coil 105 and output a feedback current $I_{f1}$.

Figure 2:
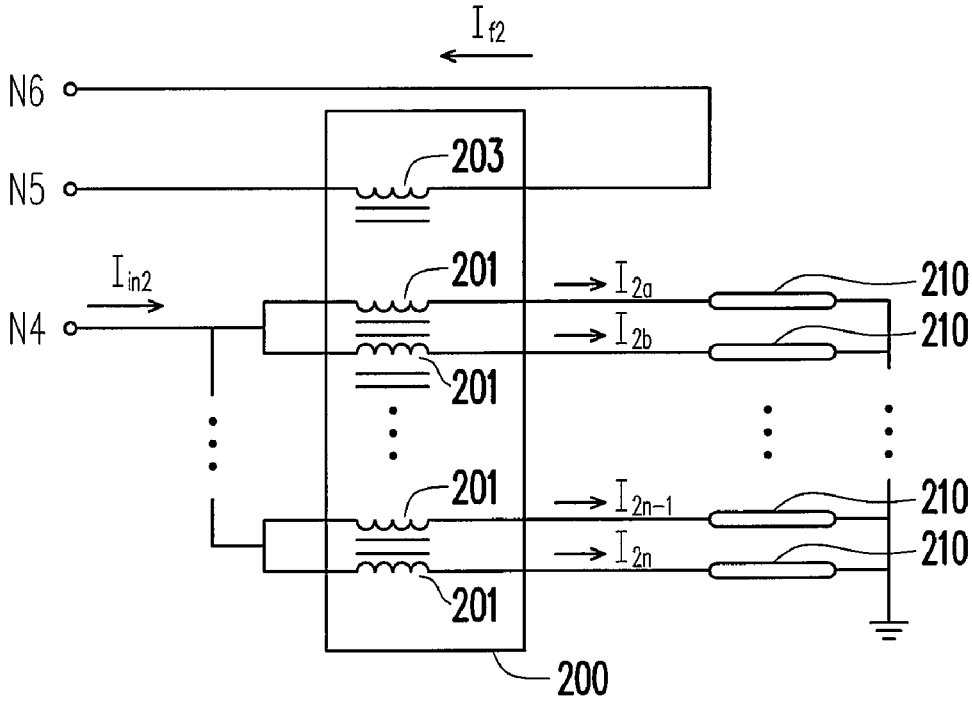
FIG. 2 is a diagram of a driving circuit with feedback control according to another embodiment of the present invention.

The inductive EMF within the coil 105 is related to the number of turns of the coil 105, thus, the inductive EMF can be adjusted by increasing or decreasing the number of turns of the coil 105 depending on the actual need, FIG. 2 is a diagram of a driving circuit with feedback control according to another embodiment of the present invention. Referring to FIG. 2, a driving circuit provided by the present embodiment includes a balancing transformer 200. The balancing transformer 200 may synchronously drive a plurality of loads 210 according to a driving signal $I_{in2}$. In the present embodiment, the driving signal $I_{in2}$ is, for example, a current which can be generated by a power conversion circuit (for example, 310 in FIG. 3).

The balancing transformer 200 includes a coil 203 and a plurality of coils 201, wherein the plurality of coils 201 are sequentially disposed at the balancing transformer 200, a terminal of each coil 201 is coupled to a node $N_4$, while other terminals thereof are respectively coupled to a corresponding load 210. In particular, the coil 203 and the plurality of coils 201 have a common core structure for generating load currents $I_{2a}$-$I_{2n}$ to drive the corresponding loads 210.

According to the principle of the magnetic circuit, the number of the coils 201 of the balancing transformer 200 is an even number. In the present embodiment, every two coils are sorted as a set, the air gap of each set of coils is the same, and the magnetic induction value and the turn number of each coil are the same. Besides, the present embodiment does not limit the ratio of the turn number of the coil 201 over the turn number of the coil 203.

Continuing to FIGS. 1 and 2, the balancing transformers 100 and 200 have same functions. The wiring and the function of the coil 203 in the balancing transformer 200 match those of the coil 105, while the wiring of the node $N_5$ and the node $N_6$ matches the node $N_2$ and the node $N_3$.

When a driving signal $I_{in2}$ flows through the plurality of coils 201, since the magnetic induction and the turn number of each the coil is the same as the other coils, and a magnetic linkage coupling is presented between the coils 201, the driving currents $I_{in2}$ would be equally assigned to each load, i.e., the load currents $I_{2a}$-$I_{2n}$ flowing through the loads 210 are the same. At the time, the electric and magnetic flux would generate an EMF in the coil 203, and output a feedback current $I_{f2}$. The number W of the balancing transformer 200 of the embodiment can be calculated by the following equations:

$$W=N+1 \quad (1)$$

$$\text{Lamp number}=N \quad (2)$$

In the above-given equations, W represents the number of the coils of the balancing transformer 200, N represents the number of coils coupled to the loads from the balancing transformer 200 and Lamp number represents the number of the loads 210 to be synchronously driven. In the present embodiment, N is an integer greater than 1.

Figure 3:
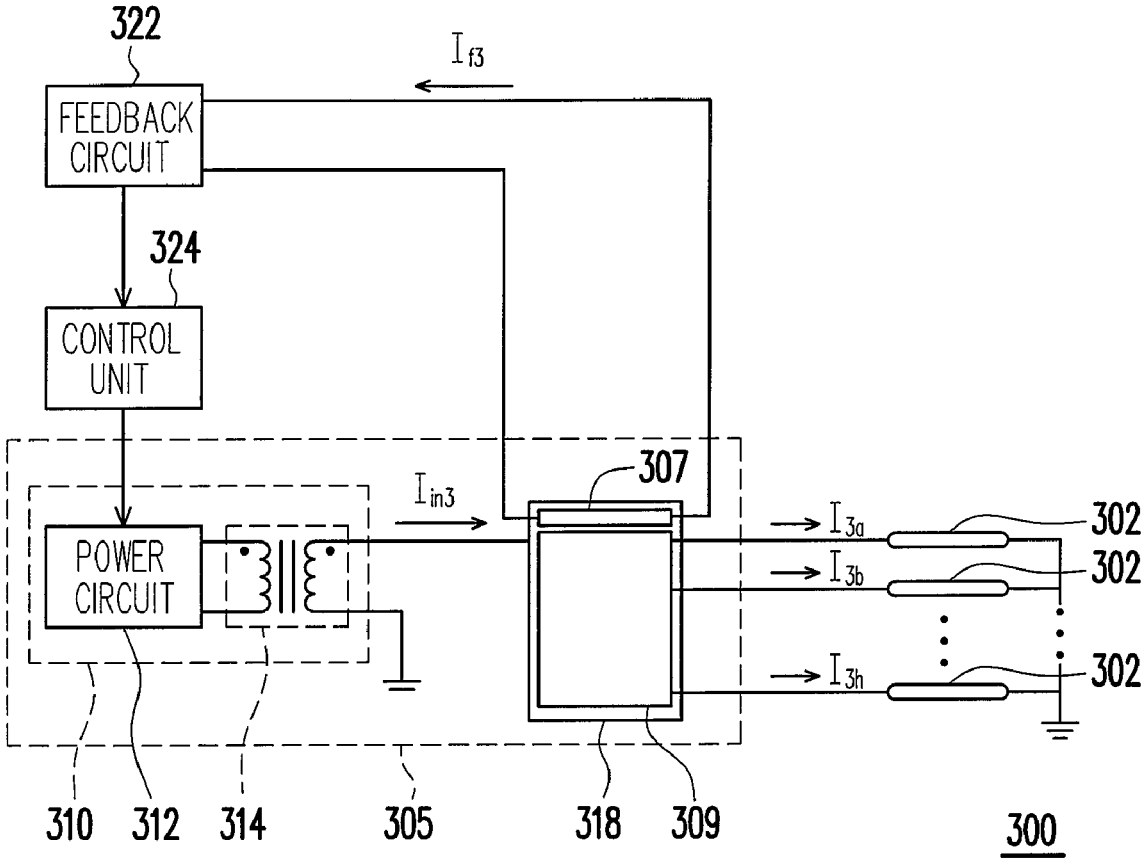
FIG. 3 is a circuit diagram of a lighting apparatus according to an embodiment of the present invention.

The preferred embodiments of the above-mentioned driving circuit are depicted as follows. FIG. 3 is a circuit diagram of a lighting apparatus according to an embodiment of the present invention. Referring to FIG. 3, a lighting apparatus 300 includes a plurality of light sources 302 and a power conversion circuit 305, wherein the light source driving circuit 305 is employed for driving every light source, while the light sources 302 comprise, for example, a cathode fluorescence lamp (CFL).

The light source driving circuit 305 includes a power conversion circuit 310 and a balancing transformer 318, wherein the balancing transformer 318 can be implemented by using the architecture of FIG. 2 and, thus, includes a plurality of load-driving coils 309 and a feedback generation coil 307. Referring to FIGS. 2 and 3, the balancing transformer 318 and the balancing transformer 200 have the same function, the wiring and the function of the feedback generation coil 307 and the balancing transformer 318 match with those of the coil 203, while the wirings and the functions of the plurality of load-driving coils 309 match with those of the coils 201 and the turn number of each the load-driving coil is the same as the others.

In the present embodiment the plurality of load-driving coils 309 has a common core structure and the number of the load-driving coils 309 is an even number. In addition, the present invention does not limit the turn numbers of the plurality of load-driving coils 309 and the feedback generation coil 307.

For driving the light sources 302, a driving signal $I_{in3}$ is generated by the power conversion circuit 310 to drive every light source though the plurality of load-driving coils 309. The feedback generation coil 307 is able to generate a feedback current $I_{f3}$ based on the inductions of the electric and magnetic flux generated by the currents $I_{3a}$-$I_{3n}$ flowing though the plurality of load-driving coils 309. Since the magnetic inductions and the turn numbers of all the load-driving coil 309 are the same, and a magnetic linkage coupling is presented between the load-driving coils 309, thus, the load currents $I_{3a}=I_{3b}=\ldots=I_{3n}$. In this way, the driving currents of all the light sources are same the luminance of all the light sources may have the same luminance.

The power conversion circuit 310 includes a power circuit 312 and a transformer 314. The power circuit 312 of the present embodiment is suitable for electrically connecting to a power supply, while the transformer 314 has a primary side and a secondary side, wherein the primary side is coupled to the power circuit 312, so that the power supply can deliver electrical energy to the transformer 314 and a driving signal is thereby output to the balancing transformer 318 from the secondary side of the transformer 314.

Referring to FIG. 3, the lighting apparatus 300 of the embodiment may further include a feedback circuit 322 and a control unit 324. The feedback circuit 322 is coupled to the second terminal of the feedback generation coil 307 for receiving a feedback current $I_{f3}$, while the control unit 324 compares the feedback current $I_{f3}$ with a preferred ideal current value. If the feedback current $I_{f3}$ is greater than the ideal current value, the feedback current $I_{f3}$ is lowered by an adjustment; if the feedback current $I_{f3}$ is less than the ideal current value, the feedback current $I_{f3}$ is increased by an adjustment; the adjusted current is then transmitted to the power conversion circuit 310. In this way, the power conversion circuit 310 is able to generate an updated driving signal to drive the light sources 302 according to the adjusted current, which enables the luminance of the light sources 302 reach an ideal setting value.

Figure 4:
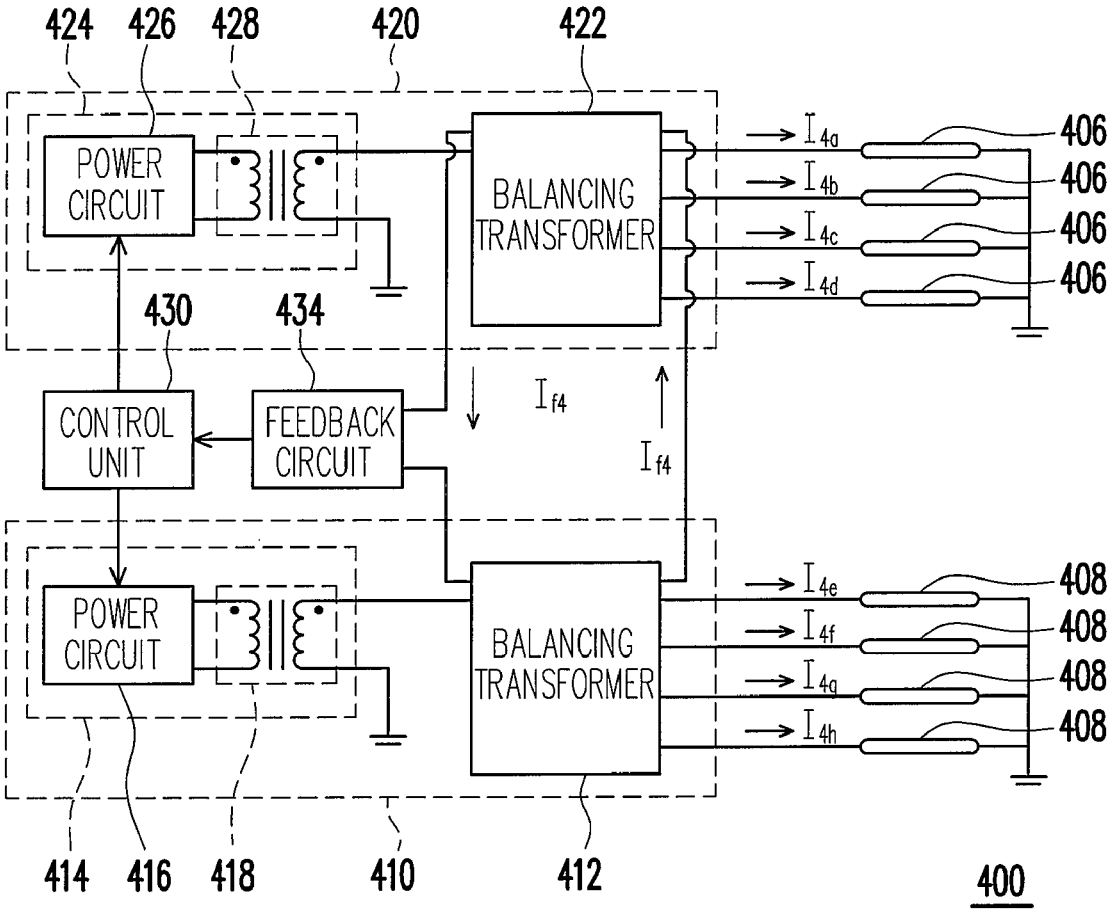
FIG. 4 is a diagram of a lighting apparatus according to an embodiment of the present invention.

FIG. 4 is a circuit diagram of a lighting apparatus according to another embodiment of the present invention. Referring to FIG. 4, a lighting apparatus 400 includes a plurality of light sources 406, a plurality of light sources 408, light source driving circuits 410 and 420, a control unit 430 and a feedback circuit 434. Specifically, the present embodiment employs two light source driving circuits 410 and 420 to drive the two sets of light sources 406 and 408.

Referring to FIGS. 3 and 4, the light source driving circuits 410 and 420 have the same function as that of the light source driving circuit 305, the wirings and the functions of the power conversion circuits 414 and 424 the light source driving circuits 410 and 420 contain match with those of the power conversion circuit 310, the wirings and the functions of the balancing transformers 418 and 428 match with those of the balancing transformer 318, the wirings and the functions of the power circuits 416 and 426 the power conversion circuits 414 and 424 match with those of the power circuit 312 and the wirings and the functions of the transformers 418 and 428 match with those of the transformer 314. In addition, the wirings and the functions of the control unit 430 and the feedback circuit 434 respectively match with those of the control unit 324 and the feedback circuit 322.

In the present embodiment, the light source driving circuits 410 and 420 are used to drive eight light sources. However, those skilled in the art would understand that the balancing transformers 412 and 422 can respectively drive N sets of light sources, as shown by FIG. 2, where N is an integer greater than 1. Similarly to FIG. 3, the load currents $I_{4a}$-$I_{4b}$ are the same, that is, the load currents $I_{4a}=I_{4b}=\ldots=I_{4h}$.

Continuing to FIG. 4, in the present embodiment, the feedback generation coils of the balancing transformers 412 and 422 are connected to each other at the two terminals with a same polarity thereof and the other two terminal thereof are coupled to the feedback circuit 434 to form a feedback signal loop. When one of the balancing transformers generates a feedback current $I_{f4}$, the feedback current $I_{f4}$ would be transmitted to the feedback circuit 434 through the loop. The feedback circuit 434 transmits the feedback current $I_{f4}$ to the control unit 430 where the feedback current $I_{f4}$ is adjusted to the ideal current value. The control unit 430 transmits the adjusted currents to the power conversion circuits 414 and 424, respectively. In this way, the power conversion circuits 414 and 424 are able to generate an updated driving signal to respectively drive the light sources 406 and 406 according to the adjusted current, which enables the luminance of the light sources 406 and 408 reach an ideal setting value.

Figure 5:
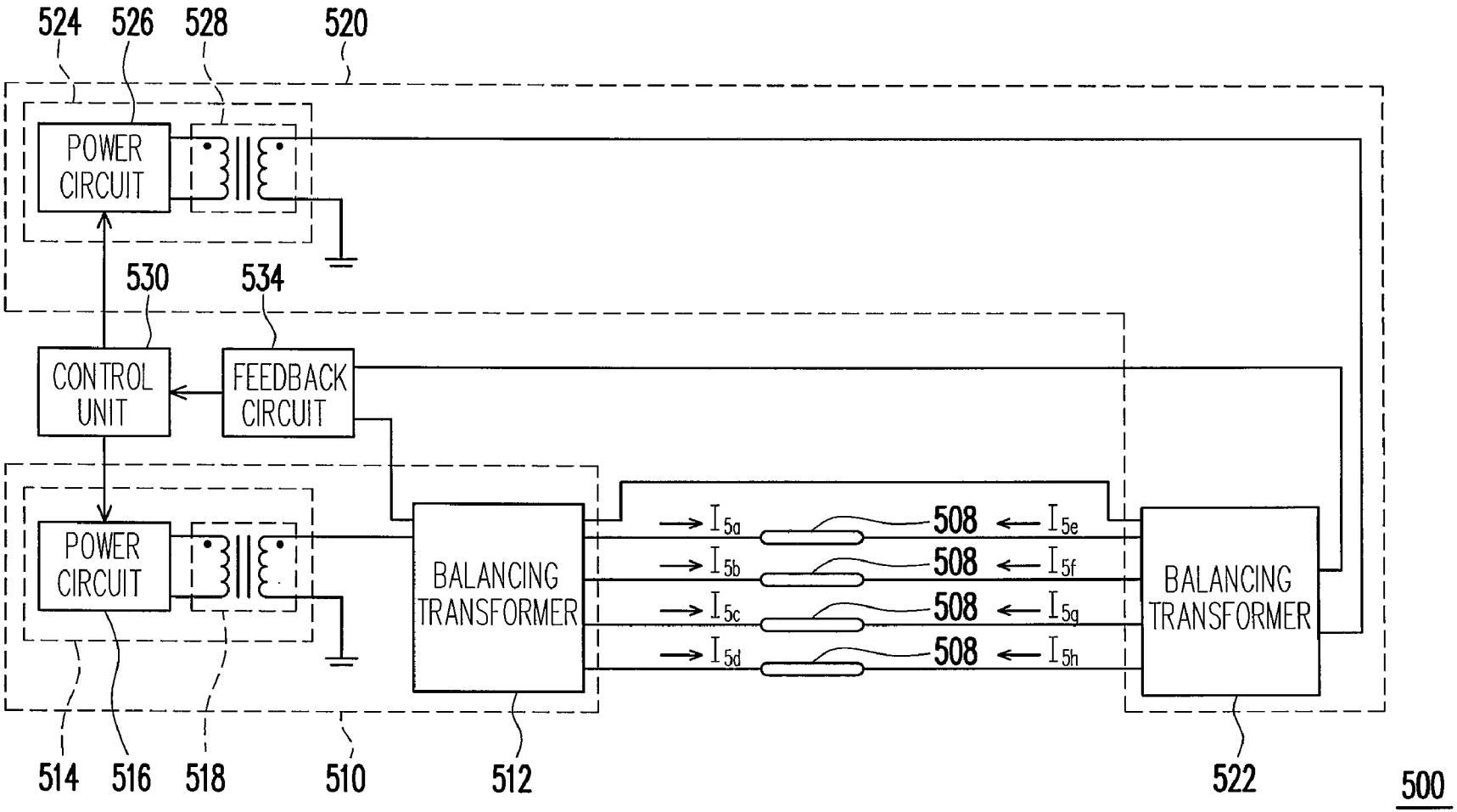
FIG. 5 is a diagram of a lighting apparatus according to an embodiment of the present invention.

FIG. 5 is a diagram of a lighting apparatus according to another embodiment of the present invention. Referring to FIG. 5, a lighting apparatus 500 includes a plurality of light sources 508, light source driving circuits 510 and 520, a control unit 530 and a feedback circuit 534.

Referring to FIGS. 4 and 5, the light source driving circuits 510 and 520 have the same function as the light source driving circuits 410 and 420, the wirings and the functions of the power conversion circuits 514 and 524 the light source driving circuits 510 and 520 match with those of the power conversion circuits 414 and 424, the wirings and the functions of the balancing transformers 512 and 522 match with those of the balancing transformers 412 and 422, the wirings and the functions of the power circuits 516 and 526 the power conversion circuits 514 and 524 match with those of the power circuits 416 and 426 and the wirings and the functions of the transformers 518 and 528 match with those of the transformers 418 and 428. In addition, the wirings and the functions of the control unit 530 and the feedback circuit 534 respectively match with those of the control unit 430 and the feedback circuit 434.

It is noted that the plurality of light sources 508 is disposed between the two balancing transformers 512 and 522, and the load currents $I_{5a}$-$I_{5d}$ provided by the balancing transformer 512 and the load currents $I_{5e}$-$I_{5h}$ provided by the balancing transformer 522 are inverted to each other. In addition, the architecture of the present embodiment not only ensures the load current of each light source is substantially identical to each other, but also achieves a goal of integrating different feedback signals into an analog feedback current signal by means of a coordination operation between the feedback generation coils, which evenly balances the output energies from a set of terminals of the light source driving circuit 510 and a set of terminals of the light source driving circuit 520.

In summary, the balancing transformer of the present invention has a feedback function, wherein by means of the design of the common core, the electric and magnetic fluxes along the core magnetic circuits are inducted by each other and a magnetic linkage coupling is presented between the load coil, so that the load current flowing through each load-driving coil is the same as the others. In addition, the balancing transformer includes a feedback generation coil and by means of the energies in the other coils inducted by the electric and magnetic fluxes, the feedback generation coil outputs a feedback current. Furthermore, the control unit is used to adjust the feedback current to a preferred ideal current value to make the luminance of the light sources reach an ideal setting value.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light source driving circuit for synchronously driving a plurality of light sources, comprising:

a power conversion circuit for generating a driving signal;

a common core structure having a plurality of load-driving coils, and being directly connected to the light sources, for receiving the driving signal and respectively driving the light sources; and a feedback signal generation coil for generating a feedback signal to the power conversion circuit based upon the inductions of the currents flowing though the load-driving coils.

2. The light source driving circuit according to claim 1, wherein the turn numbers of the load-driving coils are the same.

3. The light source driving circuit according to claim 1, wherein the common core structure comprises feedback a signal generation coil and the load-driving coils.

4. The light source driving circuit according to claim 1, wherein the number of the load-driving coils is an even number.

5. The light source driving circuit according to claim 1, wherein the load-driving coils and the feedback generation coil have the same turn number.

6. The light source driving circuit according to claim 1, wherein the turn numbers of the load-driving coils are different from that of the feedback signal generation coil.

7. The light source driving circuit according to claim 1, wherein the light sources comprise a cathode fluorescence lamp (CFL).

8. The light source driving circuit according to claim 1, wherein the power conversion circuit comprises:

a power circuit electrically connecting to a power supply; and a transformer having a primary side and a secondary side, wherein the primary side is coupled to the power circuit and the secondary side outputs the driving signal.

9. A lighting apparatus, comprising:

a plurality of first light sources;

a first power conversion circuit for generating a first driving signal to drive the first light sources;

a common-core structure having a plurality of first load-driving coils, wherein a first terminal of each of the first load-driving coils receives a first driving signal and second terminals of the first load-driving coils are respectively, correspondingly, and directly connected to the first light sources; and a first feedback signal generation coil for generating a feedback signal to the power conversion circuit based upon inductions of the currents flowing though the load-driving coils.

10. The lighting apparatus according to claim 9, wherein the common core structure comprises the first feedback signal generation coil and the first load-driving coils.

11. The lighting apparatus according to claim 9, wherein turn numbers of the first load-driving coils are different from each other.

12. The lighting apparatus according to claim 9, wherein the number of the first load-driving coils is an even number.

13. The lighting apparatus according to claim 9, wherein the turn numbers of the first load-driving coils are different from that of the feedback signal generation coil.

14. The lighting apparatus according to claim 9, wherein the first light sources comprise a cathode fluorescence lamp (CFL).

15. The lighting apparatus according to claim 9, wherein the first power conversion circuit comprises:

a power circuit electrically connecting to a power supply; and a transformer having a primary side and a secondary side, wherein the primary side is coupled to the power circuit and the secondary side outputs the first driving signal.

16. The lighting apparatus according to claim 9, further comprising:

a feedback circuit for receiving the feedback signal; and a control unit for controlling the first power conversion circuit to adjust the first driving signal according to the output from the feedback circuit.

17. The lighting apparatus according to claim 16, further comprising a second power conversion circuit for electrically connecting to the power supply and generating a second driving signal according to the output from the control unit.

18. The lighting apparatus according to claim 16, further comprising:

a plurality of second light sources;

a common core structure having plurality of second load-driving coils, wherein the first terminal of each the second load-driving coil receives the second driving signal and the second terminals thereof are respectively coupled to a corresponding one of the second light sources; and a common core structure having a second feedback signal generation coil and the second load-driving coils, wherein a first terminal of the second feedback generation coil and a first terminal of the first feedback generation coil are coupled to the feedback circuit, and a second terminal of the first feedback generation coil and a second terminal of the second feedback generation coil are coupled to each other to transmit the feedback signal to the feedback circuit.

19. The lighting apparatus according to claim 18, wherein the number of the second load-driving coils is an even number.

20. The lighting apparatus according to claim 18, further comprising:

a common core structure having a plurality of third load-driving coils, wherein the first terminal of each the third load-driving coil receives the second driving signal and a second terminals thereof are respectively coupled to a corresponding one of the first light sources, and the third load-driving coils and the first load-driving coils are respectively disposed at both ends of the light sources; and a third feedback generation coil constituting the common core structure with that of the third load-driving coils, wherein the first terminal of the third feedback generation coil is coupled to the second terminal of the first feedback generation coil, a second terminal of the third feedback generation coil and the first terminal of the first feedback generation coil are coupled to the feedback circuit to transmit the feedback signal to the feedback circuit.

21. The lighting apparatus according to claim 20, wherein the number of the third load-driving coils is an even number.

22. The lighting apparatus according to claim 20, wherein the signals of the third load-driving coils to be transmitted to the first light source and the signals of the first load-driving coils to be transmitted to the first light source are inverted to each other.

23. A balancing transformer for adjusting the load current of a driving circuit; comprising:

a first coil having a first terminal for receiving a driving signal and a second terminal directly connected to a first load;

a second coil having a first terminal for receiving the driving signal and a second terminal directly connected to a second load; and a third coil for generating a feedback signal to the driving circuit based on the inductions of the currents flowing though the first coil and the second coil, wherein the first coil, the second coil and the third coil constitutes a common core structure.

24. The balancing transformer according to claim 23, wherein turn numbers of the first coil and the second coil are the same.

25. The balancing transformer according to claim 23, wherein turn numbers of the first coil, the second coil and the third coil are the same.

26. The balancing transformer according to claim 23, wherein turn numbers of the first coil, the second coil and the third coil are different from each other.

27. A lighting apparatus, comprising:

a plurality of first light sources;

a plurality of second light sources;

a first power conversion circuit for generating a first driving signal to drive the first light sources;

a first core structure having a plurality of first load-driving coils, wherein a first terminal of each the first load-driving coil receives a first driving signal and second terminals thereof are respectively coupled to one of the first light sources;

a first feedback signal generation coil for generating a feedback signal to the power conversion circuit based upon inductions of the currents flowing though the load-driving coils;

a feedback circuit for receiving the feedback signal;

a control unit for controlling the first power conversion circuit to adjust the first driving signal according to the output from the feedback circuit; and a second core structure having a second feedback signal generation coil and a plurality of second load-driving coils, wherein the first terminal of each the second load-driving coil receives the second driving signal and the second terminals thereof are respectively coupled to a corresponding one of the second light sources, wherein a first terminal of the second feedback generation coil and a first terminal of the first feedback generation coil are coupled to the feedback circuit, and a second terminal of the first feedback generation coil and a second terminal of the second feedback generation coil are coupled to each other to transmit the feedback signal to the feedback circuit.

28. The lighting apparatus according to claim 27, wherein the number of the second load-driving coils is an even number.

29. The lighting apparatus according to claim 27, further comprising:

a third core structure having a plurality of third load-driving coils, wherein the first terminal of each the third load-driving coil receives the second driving signal and a second terminals thereof are respectively coupled to a corresponding one of the first light sources, and the third load-driving coils and the first load-driving coils are respectively disposed at both ends of the light sources; and a third feedback generation coil constituting the third core structure with that of the third load-driving coils, wherein the first terminal of the third feedback generation coil is coupled to the second terminal of the first feedback generation coil, a second terminal of the third feedback generation coil and the first terminal of the first feedback generation coil are coupled to the feedback circuit to transmit the feedback signal to the feedback circuit.

30. The lighting apparatus according to claim 27, wherein the number of the third load-driving coils is an even number.

31. The lighting apparatus according to claim 27, wherein the signals of the third load-driving coils to be transmitted to the first light source and the signals of the first load-driving coils to be transmitted to the first light source are inverted to each other.

* * * * *